US009095177B2

(12) United States Patent
Ota et al.

(10) Patent No.: US 9,095,177 B2
(45) Date of Patent: Aug. 4, 2015

(54) PHYSICAL FITNESS GARMENTS

(75) Inventors: Kosaku Ota, Tokyo (JP); Mayumi Tayanaka, Tokyo (JP); Asuka Iso, Tokyo (JP); Hideo Suzuki, Tokyo (JP); Ken Takagi, Tokyo (JP)

(73) Assignee: REEBOK INTERNATIONAL LIMITED, London (GB)

( * ) Notice: Subject to any disclaimer, the term of this patent is extended or adjusted under 35 U.S.C. 154(b) by 726 days.

(21) Appl. No.: 13/070,964

(22) Filed: Mar. 24, 2011

(65) Prior Publication Data

US 2011/0237995 A1 Sep. 29, 2011

Related U.S. Application Data

(60) Provisional application No. 61/318,208, filed on Mar. 26, 2010.

(51) Int. Cl.

| | |
|---|---|
| ***A41D 13/00*** | (2006.01) |
| ***A43B 13/14*** | (2006.01) |
| ***A63B 21/00*** | (2006.01) |
| *A63B 21/055* | (2006.01) |

(52) U.S. Cl.

CPC ..... *A41D 13/0015* (2013.01); *A43B 13/145* (2013.01); *A63B 21/1423* (2013.01); *A63B 21/1449* (2013.01); *A41D 2400/38* (2013.01); *A63B 21/055* (2013.01)

(58) Field of Classification Search

CPC A41D 1/067; A41D 2400/38; A41D 2600/10
USPC ..... 2/69, 79, 227
See application file for complete search history.

(56) References Cited

U.S. PATENT DOCUMENTS

| | | | | |
|---|---|---|---|---|
| 6,047,406 | A | 4/2000 | Dicker et al. | |
| 6,186,970 | B1 * | 2/2001 | Fujii et al. | 602/75 |
| 7,229,390 | B2 * | 6/2007 | Fujii et al. | 482/124 |

(Continued)

FOREIGN PATENT DOCUMENTS

| | | |
|---|---|---|
| EP | 1752054 A1 | 2/2007 |
| EP | 1980165 A1 | 10/2008 |

OTHER PUBLICATIONS

International Search Report for International Application No. PCT/US2011/029768, dated May 20, 2011, 7 pages.

(Continued)

*Primary Examiner* — Danny Worrell
*Assistant Examiner* — Khaled Annis
(74) *Attorney, Agent, or Firm* — Sterne, Kessler, Goldstein & Fox, P.L.L.C.

(57) ABSTRACT

Physical fitness garments are disclosed. In an embodiment, a garment for being placed in contact with a wearer's limb includes a base layer having a base level resistance to stretching, and an activation element coupled to the base layer, the activation element comprising a lattice pattern and having a resistance to stretching greater than the base level resistance to stretching, wherein said activation element is configured to be placed in contact with the back of the wearer's thigh, not to extend above the upper most extent of the gluteus maximus, and not to extend below the knee, and wherein the garment is configured to be able to cause increased activity in a first muscle in the wearer's limb during a locomotion movement via an increase in the resistance to contraction of the first muscle provided by the garment during locomotion of the wearer.

43 Claims, 9 Drawing Sheets

(56) References Cited

U.S. PATENT DOCUMENTS

| | | | | |
|---|---|---|---|---|
| 7,631,367 | B2 * | 12/2009 | Caillibotte et al. | 2/228 |
| 7,730,552 | B2 * | 6/2010 | Ota et al. | 2/69 |
| 8,245,324 | B2 * | 8/2012 | Kawasaki et al. | 2/227 |
| 2003/0028952 | A1 * | 2/2003 | Fujii et al. | 2/400 |
| 2004/0107479 | A1 | 6/2004 | Dicker et al. | |
| 2004/0111781 | A1 * | 6/2004 | Miyake et al. | 2/69 |
| 2004/0255358 | A1 | 12/2004 | Ota et al. | |
| 2005/0193461 | A1 * | 9/2005 | Caillibotte et al. | 2/69 |
| 2007/0074328 | A1 | 4/2007 | Melhart et al. | |
| 2008/0295230 | A1 | 12/2008 | Wright et al. | |
| 2010/0043114 | A1 * | 2/2010 | Caillibotte et al. | 2/69 |

OTHER PUBLICATIONS

Written Opinion for International Application No. PCT/US2011/029768, dated May 20, 2011, 7 pages.

Notification of Transmittal and International Preliminary Report on Patentability for International Application No. PCT/US11/29768, dated May 14, 2012, 8 pages.

* cited by examiner

PHYSICAL FITNESS GARMENTS

FIELD OF THE INVENTION

The present invention generally relates to garments. More particularly, the present invention relates to physical fitness garments.

BACKGROUND OF THE INVENTION

Physical activity is important to maintaining a healthy lifestyle and individual well-being. There are many activities in daily life that require individuals to use their strength, agility, and balance, and maintaining physical fitness can help individuals complete these activities with minimum disruption to their lives. Maintaining physical fitness has also been shown to strengthen the heart, boost HDL cholesterol, aid the circulatory system, and lower blood pressure and blood fats, translating to lower risk for heart disease, heart attack, and stroke. Physical activity also strengthens muscles, increases flexibility, and promotes stronger bones, which can help prevent osteoporosis.

Garments worn during physical activities should not hinder the wearer's performance of their activity, and should ideally support the user in achieving their physical fitness goals. Garments are known that purport to assist a user in achieving a variety of fitness goals, including increasing muscle activation in desired locations. However, existing garments often suffer from myriad problems such as poor functionality, uncomfortable fit, high cost, and undesirable aesthetics.

There is a need for garments with improved functionalities that may solve one or more of the above mentioned problems with existing garments. There is also a need for garments that allow a wearer to better achieve his or her physical fitness goals while engaging in physical activity throughout the course of his or her daily routine, while minimizing the time investment required.

BRIEF SUMMARY OF THE INVENTION

Embodiments of the present invention relate to a garment for being placed in contact with a wearer's limb, which may include a base layer having a base level resistance to stretching, and an activation element coupled to the base layer, the activation element comprising a lattice pattern and having a resistance to stretching greater than the base level resistance to stretching, wherein said activation element is configured to be placed in contact with the back of the wearer's thigh, not to extend above the upper most extent of the gluteus maximus, and not to extend below the knee, and wherein the garment is configured to be able to cause increased activity in a first muscle in the wearer's limb during a locomotion movement via an increase in the resistance to contraction of the first muscle provided by the garment during locomotion of the wearer.

Embodiments of the present invention also relate to a garment for being placed in contact with a wearer's limb, which may include a base layer having a base level resistance to stretching, and an activation element coupled to the base layer, the activation element having a first resistance to stretching that is more resistant to stretching than the base level resistance to stretching, wherein said activation element is configured to be placed in contact with the back of the wearer's thigh, not to extend above the upper most extent of the gluteus maximus, and not to extend below the knee, and wherein the garment is configured to be able to cause increased activity in a muscle in the wearer's limb during a locomotion movement via an increase in compression about the limb provided by the garment during locomotion of the wearer.

Embodiments of the present invention further relate to a garment for being placed in contact with a wearer's limb, which may include a base layer having a base level resistance to stretching, and an activation element coupled to the base layer, the activation element having a resistance to stretching greater than the base level resistance to stretching, wherein said activation element is configured to be placed in contact with the back of the wearer's thigh, not to extend above the upper most extent of the gluteus maximus, and not to extend below the knee, wherein the garment is configured to be able to cause increased activity in a first muscle in the wearer's limb during a locomotion movement via an increase in the resistance to contraction of the first muscle provided by the garment during locomotion of the wearer, and wherein the garment is configured to be able to cause increased activity in a second muscle in the wearer's limb during a locomotion movement via an increase in compression about the limb provided by the garment during locomotion of the wearer.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention by way of example, and not by way of limitation, and, together with the description, further serve to explain the principles of the invention and to enable a person skilled in the pertinent art to make and use the invention.

DETAILED DESCRIPTION OF THE INVENTION

The present invention will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but that every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Figure 1A:
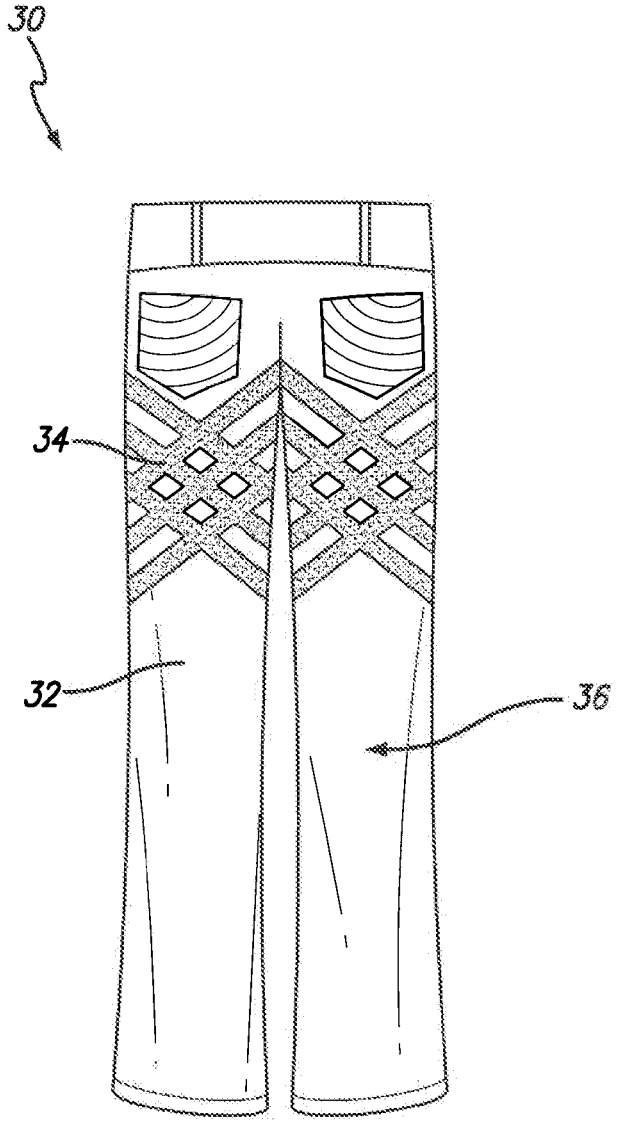
FIG. 1A is a rear view of an outside surface of a garment according to an embodiment of the present invention.
Figure 1B:
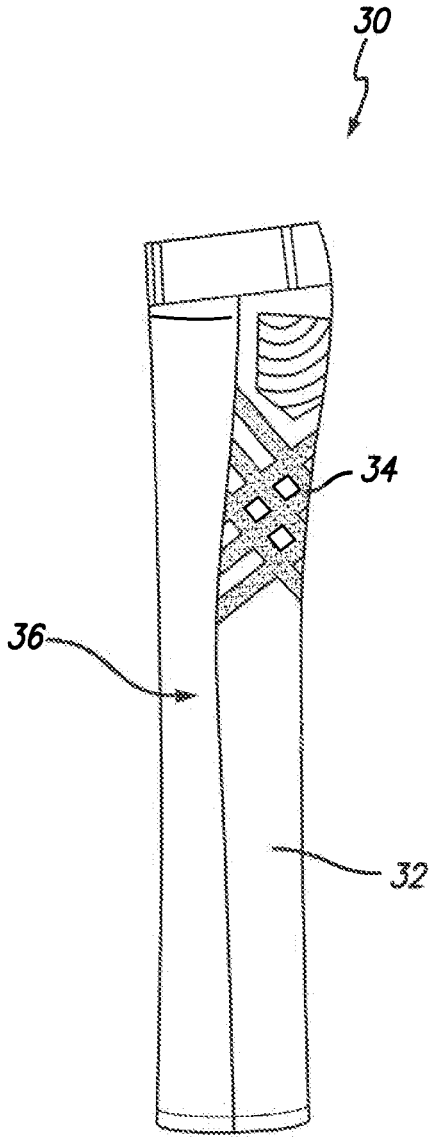
FIG. 1B is a left side view of an outside surface of the garment of FIG. 1A according to an embodiment of the present invention.

FIGS. 1A and 1B are illustrations of a garment 30 that may be worn by a wearer while engaging in physical activities. Physical activities may include activities such as walking, running, and jumping that may occur in the ordinary course a person's daily routine (e.g. while doing work, running errands, gardening, etc.) or during predetermined athletic activities (e.g. while engaged in a workout, participating in a sport, etc.)

According to an embodiment of the present invention, the garment 30 may be configured for being placed in contact with a wearer's limb. The garment 30 may include a base layer 32 and an activation element 34. As described in further detail below, the garment 30 may further be configured to be able to cause increased activity in a muscle 12 in the wearer's limb during a locomotion movement. Increased muscular activity may beneficially result in increased calorie consumption and toning of the activated muscles 12, which may further lead to improved posture and balance.

Figure 8:
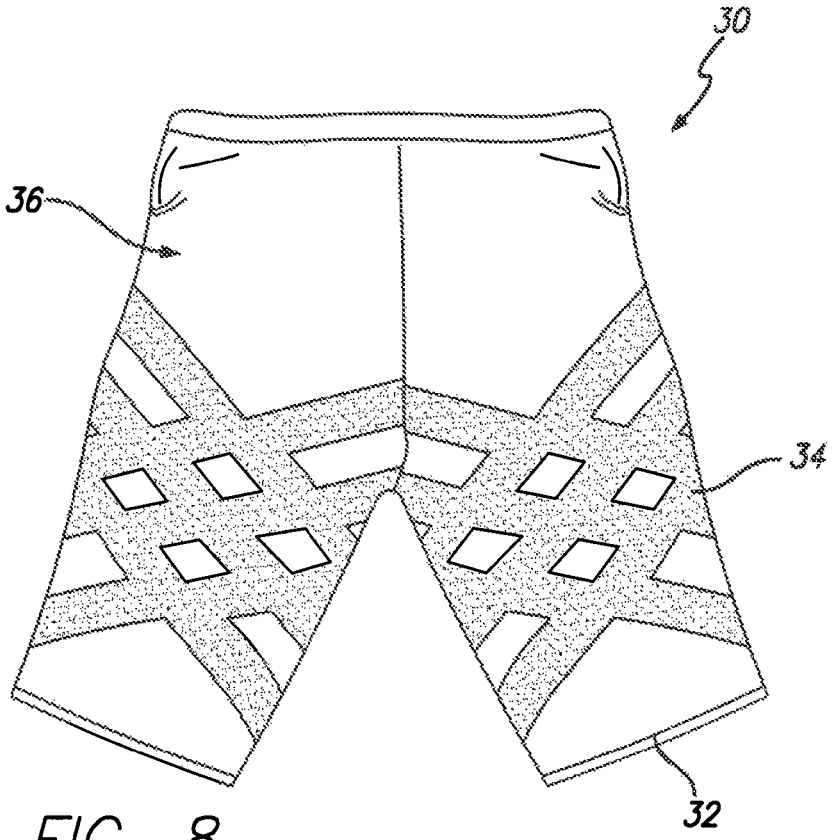
FIG. 8 is a rear view of an outside surface of a garment according to an embodiment of the present invention.
Figure 9:
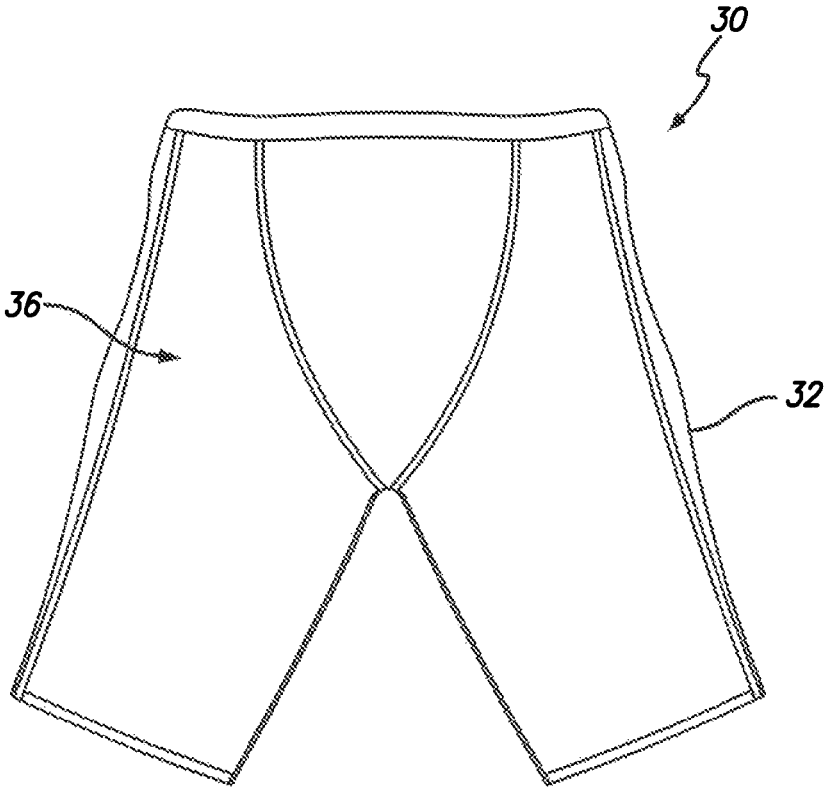
FIG. 9 is a front view of an outside surface of the garment of FIG. 8 according to an embodiment of the present invention.

With reference to FIGS. 1A and 1B, which provide rear side and left side views of the outer surface 36 of a garment 30, respectively, in one embodiment of the present invention, the garment 30 may be a pair of pants. In other embodiments, the garment 30 may be any garment 30 capable of being coupled to the lower and/or upper body. For example, the garment 30 may be a pair of shorts, a lower or upper body undergarment, a shirt, or other suitable garment for physical activity. FIGS. 8 and 9 illustrate rear and front side views of the outer surface 36 of a garment 30, respectively, in the form of a pair of shorts.

The base layer 32 of the garment 30 may be made up of one or more natural or synthetic textiles, or combinations thereof. Suitable textiles may include, for example, those made of cotton, flax, silk, polyester, aramid, acrylic, nylon, polyurethane, spandex, and/or olefin. In one embodiment, the base layer 32 of the garment 30 may include a blend of nylon and polyurethane. In an embodiment, the nylon-polyurethane blend may include between about 70% and about 80% nylon and between about 20% and about 30% polyurethane. The textiles making up the base layer 32 may, for example, be woven, knit, or composite textiles. In an embodiment, the base layer 32 may be fabricated as a single, unitary structure. In other embodiments, the base layer 32 may be fabricated by cutting and coupling various pieces of textiles together. Because the garments 30 of embodiments of the present invention are capable of being assembled from one or more different textiles, garments 30 of a variety of styles with a variety of desirable properties may be fabricated.

The base layer 32 may be a continuous structure of sufficient size to extend about one or more limbs of a wearer of the garment 30. For example, in an embodiment where the garment 30 is a pair of pants, the base layer 32 may extend about the wearer's hips and legs. In some embodiments, the base layer 32 is coextensive with the garment 30 itself. In an embodiment, the base layer 32 includes a mesh material that allows skin to breath through the garment 30 and/or that helps help wick moisture away from the wearer's body. Breathability and moisture wicking may be of particular utility in applications where the person wearing the garment 30 is engaged in physical activity at a high enough intensity level for a long enough period that they may expect to perspire.

The activation element 34 may be disposed on the base layer 32, or, alternatively, may be integrally formed with base layer 32. In embodiments where the activation element 34 is disposed on the base layer 32, the activation element 34 may comprise materials including, but not limited to, silicon, a thermoplastic or thermosetting polymer, rubber, polyurethane, or a laminate. In an embodiment, these materials may be sprayed, printed, or formed as tape and applied to the base layer 32. The activation element 34 may also comprise one or more natural or synthetic textiles, or combinations thereof, including, but not limited to, cotton, silk, flax, polyester, aramid, acrylic, nylon, polyurethane, spandex, and/or olefin fibers. In one embodiment, the activation element 34 of the garment 30 may include a blend of nylon and polyurethane. In an embodiment, the nylon-polyurethane blend may include between about 70% and about 80% nylon and between about 20% and about 30% polyurethane. In some embodiments, it may be desirable to utilize a material for the activation element 34 that has a relatively high coefficient of friction compared to other materials.

In one embodiment, the activation element 34 may comprise a flexible tape, such as, for example, a tape which includes polyurethane, nylon, polyester, polyolefin, and/or combinations thereof. Suitable flexible tapes include, but are not limited to, part nos. 3206, 3218, 3287, 3405, 3410, 4220, 5214, 5250, 5290, 6218, ST644, ST646, ST647, TL100 OT100, 6343, 6344, 6371, and 6385 available from Bemis Associates, Inc. (Shirley, Mass.) and part nos. EXF-367 and UAF-442 available from Adhesive Films, Inc. (Pine Brook, N.J.).

In one embodiment, the activation element 34 may be coupled to the base layer 32 by stitching, by an adhesive, by an application of heat and/or pressure or other suitable method.

In embodiments in which the activation element 34 is integrally formed with the base layer 32, the activation element 34 of the garment 30 may comprise one or more natural or synthetic textiles, or combinations thereof, such as those made of cotton, flax, silk, polyester, aramid, acrylic, nylon, polyurethane, spandex, and/or olefin. In one embodiment, the base layer 32 and the activation element 34 have at least one textile in common. In another embodiment, the base layer 32 and the activation element 34 do not have a textile in common. In one embodiment, the base layer 32 and the activation layer 34 of the garment 30 may include a blend of nylon and polyurethane. In an embodiment, the nylon-polyurethane blend may include between about 70% and about 80% nylon and between about 20% and about 30% polyurethane. In some embodiments, the particular textiles used may be chosen for certain properties such as stretchability, breathability, ease of laundering, cost, etc.

Regardless of their respective textile compositions, in an embodiment, the base layer 32 and the activation element 34 may have different resistance to stretching.

In an embodiment of the present invention, the base layer 32 may have a base level resistance to stretching, while the activation element 34 may have a resistance to stretching that is greater than the base level resistance to stretching. In other words, the activation element 34 may be stiffer than the more flexible base layer 32. In alternate embodiments, the activation element 34 may have a resistance to stretching that is less than the base level resistance to stretching, or the activation element's 34 resistance to stretching may be equal to the base level resistance to stretching.

As will be explained in further detail below, employing an activation element 34 having a resistance to stretching that is greater than the base level resistance to stretching may aid in increasing muscular activity in certain target muscles 12 which may beneficially result in increasing calorie consumption and toning of the activated muscles 12, which may further lead to improved posture and balance.

In one embodiment of the present invention, the activation element 34 may be coupled to the base layer 32 by being integrally formed with the base layer 32. Despite being integrally formed with one another, the base layer 32 and the activation element 34 may still possess different resistances to stretching.

Integrally forming the base layer 32 and the activation element 34 may be accomplished in a variety of ways. For example, the activation element 34 may be integrally formed with the base layer 32 by fabricating one portion of the garment 30 including the activation element 34 differently from another portion of the garment 30 that does not include the activation element 34.

Figure 10:
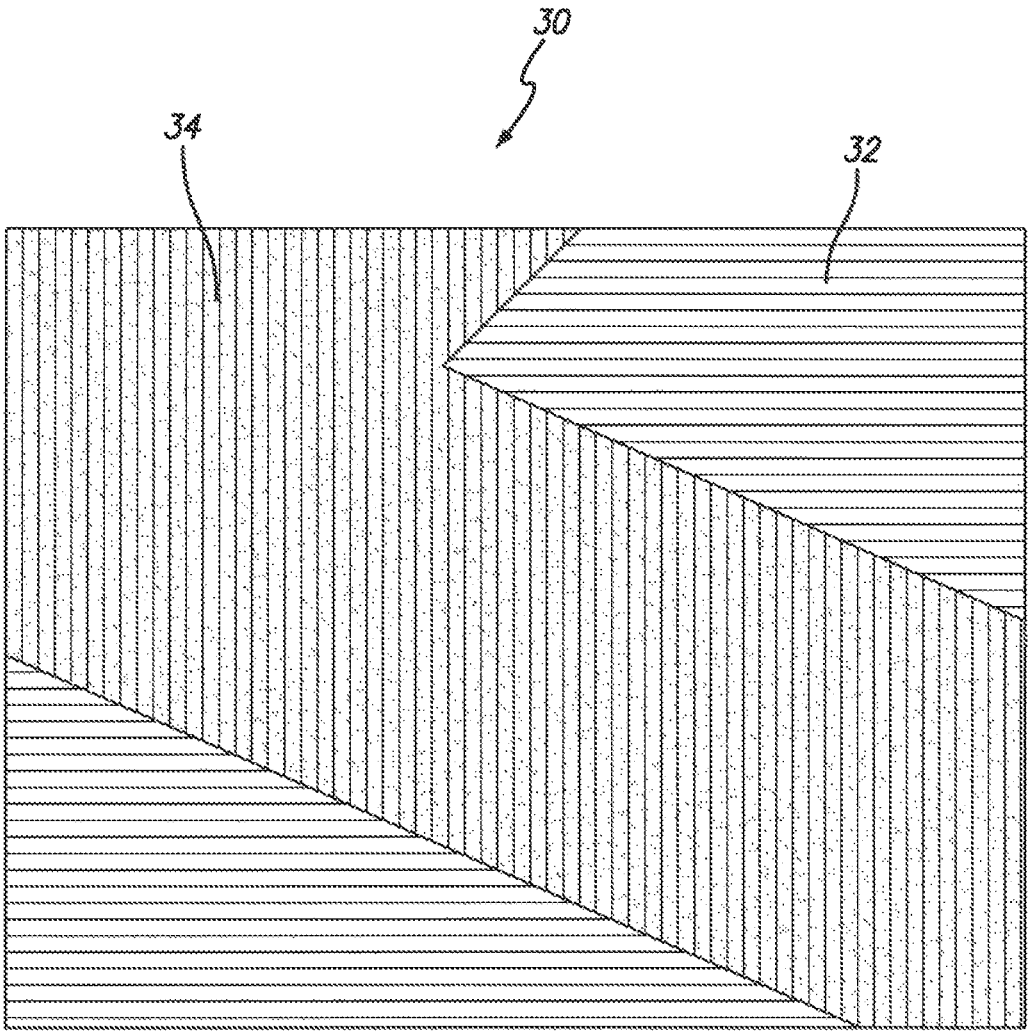
FIG. 10 is close up view of a portion of the outside surface of the garment of FIG. 8 according to an embodiment of the present invention.

In one embodiment, the activation element 34 is integrally formed with the base layer 32 by using different knitting or weaving techniques or features in different portions of the garment 30. This is illustrated in FIG. 10, wherein one weaving technique has been used for a portion of the garment 30 including the activation element 34, while another type of weaving technique may be used for a portion of the garment 30 not including the activation element 34. As can be seen in FIG. 10, ribs or other textural elements of the textile may be oriented in varied directions as a result of the weaving technique used. For example, a jacquard weaving technique may be used for a portion of the garment 30 including the activation element 34, while another type of weaving technique may be used for a portion of the garment 30 not including the activation element 34. In another embodiment, a jacquard weaving technique may be used for the entire garment 30. In some embodiments of the present invention, different weave or knit densities may be employed.

In another embodiment, the activation element 34 is integrally formed with the base layer 32 by providing different thicknesses or textures in different portions of the garment 30. For example, a thicker depth and/or a rougher texture may be used for a portion of the garment 30 including the activation element 34, while a thinner depth and/or a smoother texture may be used for a portion of the garment 30 not including the activation element 34.

The garment 30 may be characterized as having an inner surface 38 and an outer surface 36. The inner surface 38 may be a surface that is intended to be placed in contact with the wearer's limb, while the outer surface 36 may be the surface that is opposite the inner surface 38. In some embodiments, such as the embodiment illustrated in FIGS. 1A and 1B, the outer surface 36 may be visible to others observing the wearer when the garment 30 is worn. In other embodiments, however, such as when the garment 30 is an undergarment, the outer surface 36 may not be visible to others observing the wearer when the garment 30 is worn.

In one embodiment, the activation element 34 may be present on only one surface of the garment 30. Thus, the activation element 34 may be present only on the inner surface 38 of the garment 30, or only on the outer surface 36 of the garment 30. In another embodiment, such as the embodiment illustrated in FIGS. 1A, 1B, and 2, the activation element 34 may be present on both the inner 38 and outer 36 surfaces of the garment 30. In embodiments where the activation element 34 is present on the outer surface 36 and is visible to others observing the wearer, it may be desirable to enhance the aesthetics of the garment 30 by incorporating symbols, logos, or patterns into the activation element 34.

The garment 30 having the base layer 32 and the activation element 34 may be configured to be placed in contact with a wearer's limb. In one embodiment of the present invention, the garment 30 may be placed directly in contact with the wearer's limb (i.e. the inner surface 38 of the garment 30 may physically contact the skin of the wearer's limb with no intervening structures). In another embodiment, the garment 30 may be placed in indirect contact with the wearer's limb (i.e. an intervening structure, such as an undergarment, may be present between the inner surface 38 of the garment 30 and the wearer's limb). Thus, embodiments of the present invention may be used as undergarments, linings, or as primary garments.

In embodiments where the activation element 34 is present only on the outer surface 36 of the garment 30, the activation element 34 may not be capable of directly contacting the wearer's limb. Alternatively, in embodiments where the activation element 34 is present on the inner surface 38 of the garment 30 (or both the inner 38 and outer 36 surfaces of the garment 30, such as in FIGS. 1A, 1B, and 2), the activation element 34 may be capable of directly contacting the wearer's limb.

Placing the garment 30 in contact with the wearer's limb may include donning the garment 30 (i.e. putting it on). If the garment 30 as a whole is sufficiently flexible, and if the shape of the wearer's body permits it, the garment 30 may be pulled on or otherwise manipulated into position about the limb. For example, if the garment 30 is a pair of relatively flexible pants, the pants may be pulled up over the wearer's legs toward the wearer's waist into position. In an alternate embodiment, the garment 30 may include an opening or slit along with a zipper, buttons, snaps, hook-and-loop fasteners, or other mechanical fasteners that allow the garment 30 to be temporarily enlarged or opened up at the slit or opening so that the garment 30 may be secured in an appropriate position about the limb.

In embodiments of the present invention where the activation element 34 is present at least on the inner surface 38 of the garment 30, the garment 30 may be configured such that at least a portion of the activation element 34 may be in contact with a particular portion of the wearer's limb. Similarly, the garment 30 may be configured such that the at least a portion of the activation element 34 and at least a portion of the base layer 32 may be in contact with a particular portion of the wearer's limb.

Figure 2:
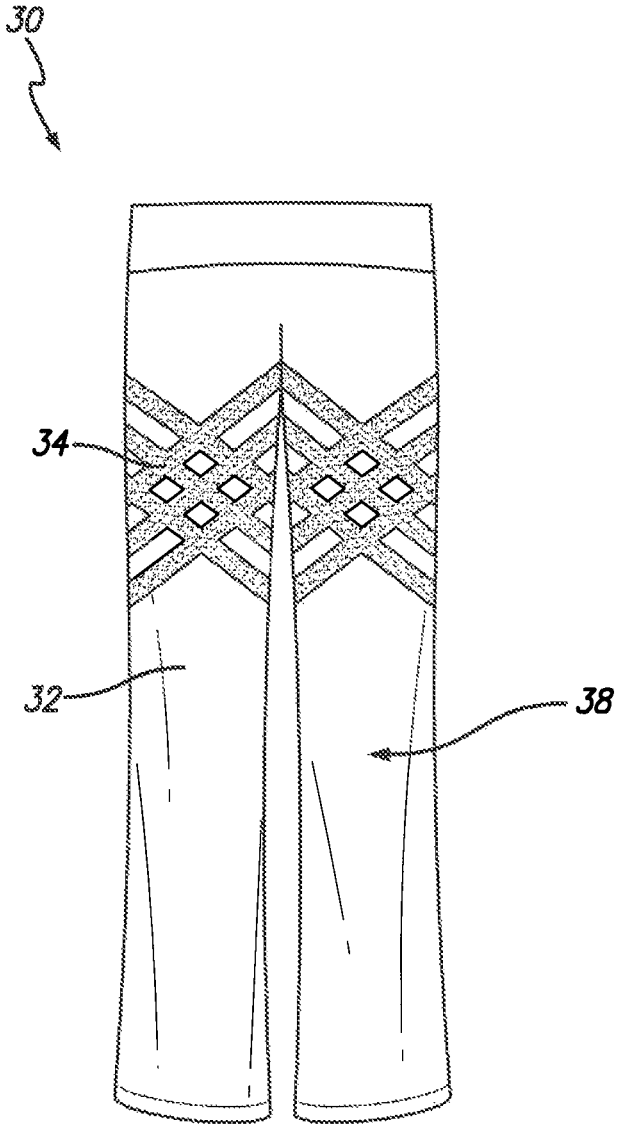
FIG. 2 is a view of an inside surface of the garment of FIG. 1A according to an embodiment of the present invention.

For example, with reference to FIG. 2, which is an illustration of an inner surface 38 of the garment 30, it can be seen that the garment 30 in the form of a pair of pants includes both a base layer 32 and an activation element 34 that are configured to be in contact with the back side of the wearer's thighs. In contrast, also as shown in FIG. 2, the portion of the inner surface 38 of the garment 30 corresponding to the lower legs of the pants that would contact the back side of the wearer's crus (i.e. lower leg) includes a base layer 32 but does not include a activation element 34.

In alternate embodiments, the particular portion of the wearer's limb targeted for contact with at least a portion of the activation element 34 may include, for example, the back of the thigh, the front of the thigh, the back of the crus (i.e. lower leg), the front of the crus, the foot, the arm, the forearm, or the hand. In one embodiment, the wearer's hip, shoulder, or buttocks may be targeted for contact with at least a portion of the activation element 34.

In another embodiment, the garment 30 may be configured such that the entire surface of the activation element 34 may be in contact with a particular portion of the wearer's limb. In embodiments of the present invention where the activation element 34 is not present on the inner surface 38 of the garment 30, the garment 30 may be configured such that the activation element 34 may not be in direct contact with a particular portion of the wearer's limb.

Garments 30 according to embodiments of the present invention may be configured to be able to cause increased activity in a muscle 12 in the wearer's limb during a locomotion movement. Increased muscular activity may beneficially result in increased calorie consumption and toning of the activated muscles 12, which may further lead to improved posture and balance.

Locomotion involves self-propulsion via the movement of the limbs. Walking, running, and jumping are all common forms of human locomotion. Many daily physical activities involve locomotion. A gait cycle model can be used to describe the complex activity of human locomotion. FIGS. 3A-3G are exemplary illustrations of the human gait cycle. This cycle describes the motions of a person's legs and feet from the time of initial placement of the supporting heel of one foot 10 on the ground to the time when the heel of the same foot 10 contacts the ground for a second time. Motion of a person's right foot 10 will be described below.

As shown in FIGS. 3A-3G, the gait cycle is typically divided into two phases: the stance phase and the swing phase. During the stance phase, the right foot 10 is in contact with the ground surface. During the swing phase, the right foot 10 swings forward in the air and is not in contact with the ground surface. Those of skill in the art will recognize that a person's left foot, also illustrated in FIGS. 3A-3G, will follow a similar (though time shifted) pattern of alternating periods of contact with and removal from the ground surface.

Figure 3:
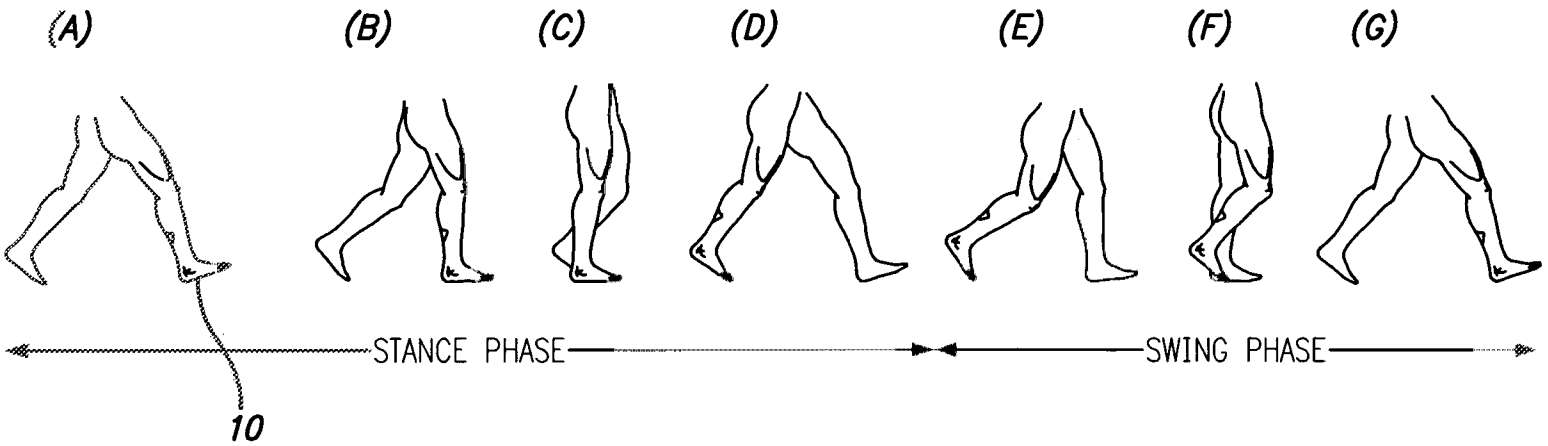
FIGS. 3A-3G are illustrations of the human gait cycle according to an embodiment of the present invention.

As shown in FIG. 3A, the stance phase of the gait cycle may begin when the heel of the person's right foot 10 strikes the ground. Next, as illustrated in FIGS. 3B and 3C, as the toe of the foot 10 contacts the ground, the foot 10 is placed flat on the ground surface, and the person continues moving forward though midstance. As shown in FIG. 3D, the heel of the foot 10 eventually rises upward from the ground surface.

The transition from the stance phase to the swing phase is illustrated in FIG. 3E as the toe of the foot 10 rises upward from the ground surface. As shown in FIG. 3F, the foot 10 then begins to accelerate and swing forward. Next, the foot 10 begins to decelerate and the heel of the foot 10 eventually comes into contact with the ground surface as illustrated by FIG. 3G. Thus, the swing phase has ended and a single gait cycle for the right foot 10 is complete.

A variety of muscles 12 are responsible for human locomotion. Lower body muscles 12 that play significant roles in locomotion include the rectus femoris 20, the biceps femoris 22, and the gluteus maximus 24. An exemplary illustration of these muscles 12 is shown in FIGS. 4 and 5.

Figure 4:
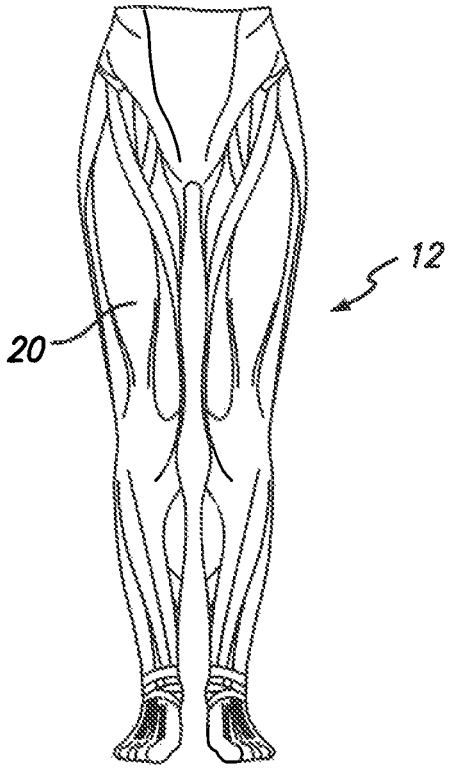
FIG. 4 is a front view of the muscles of the lower abdomen and legs of a human according to an embodiment of the present invention.

With reference to FIG. 4, which is an anterior view of the muscles 12 of the lower abdomen and legs of a human, the rectus femoris 20 is situated roughly in the middle of the front of the thigh. The rectus femoris 20 runs roughly parallel to the femur. The superior end of the rectus femoris 20 is connected by tendons to the ilium of the pelvis, while the inferior end of the rectus femoris 20 is connected by tendons to the patella. The rectus femoris 20, which is part of the quadricep group of muscles 12, is involved in knee extension during human locomotion.

Figure 5:
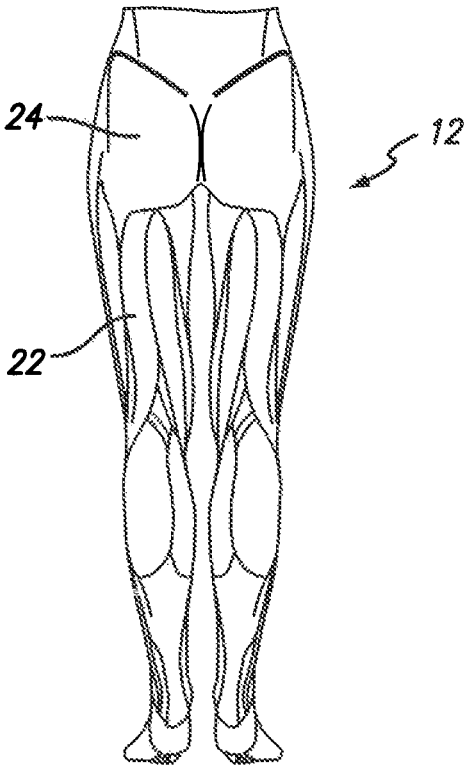
FIG. 5 is a rear view of the muscles of the lower abdomen and legs of a human according to an embodiment of the present invention.

With reference to FIG. 5, which is a posterior view of the muscles 12 of the lower abdomen and legs of a human, the long head of the biceps femoris 22 is situated roughly in the middle of the back of the thigh. The long head of the biceps femoris 22 runs roughly parallel to the femur. The superior end of the biceps femoris 22 is connected by tendons to the ischium of the pelvis, while the inferior end of the biceps femoris 22 is connected by tendons to the head of the fibula. The biceps femoris 22, which is part of the hamstring group of muscles 12, is involved in knee flexion during human locomotion.

With further reference to FIG. 5, the gluteus maximus 24 is located superior to most of the biceps femoris 22 and makes up a large portion of the buttocks. The gluteus maximus 24 arises from the crest of the ilium, the sacrum, and the coccyx, and runs obliquely downward and laterally to the gluteal tuberosity of the femur. The gluteus maximus 24 is involved in kicking the leg backward behind the body during human locomotion. The gluteus maximus 24 and the biceps femoris 22 may thus act simultaneously at certain points during human locomotion.

The biceps femoris 22 and the gluteus maximus 24 on the posterior side of the body are capable of acting as antagonists to the rectus femoris 20 on the anterior side of the body. Each of these muscles 12 are capable of playing a crucial role in many daily physical activities, such as, walking, running, and jumping.

Different muscles 12 are active at different stages of the gait cycle. For example, stages of the gait cycle involving knee extension, such as the stage depicted in FIG. 3F where the foot 10 is accelerating forward in swing phase, may require activation of the rectus femoris 20. On the other hand, stages of the gait cycle involving knee flexion and/or kicking the leg backward behind the body, such as the stage depicted in FIG. 3E where the foot 10 is moving backward as the toe is being lifted off the ground surface during the transition from the stance phase to the swing phase, may require activation of the biceps femoris 22 and/or the gluteus maximus 24.

Many individuals are deterred from utilizing exercise equipment to tone their muscles 12 because this often bulky equipment can be difficult to store in a convenient location, difficult or impossible to bring along when the user travels, and expensive. The garments 30 of embodiments of the present invention may allow a wearer to better achieve his or her physical fitness goals while engaging in physical activity throughout the course of his or her daily routine, without having to rely on bulky utilizing exercise equipment. And while the garments 30 of embodiments of the present invention may be used during predetermined athletic activities (e.g. while engaged in a workout, participating in a sport, etc.), they are also capable of being used throughout the course of a person's daily routine (e.g. while doing work, running errands, gardening, etc.).

The garments 30 of the present invention may be configured to be able to cause increased activity in a muscle 12 in the wearer's limb during a locomotion movement.

In one embodiment, the garment 30 is configured to be able to cause increased activity in a first muscle 12 in the wearer's limb during a locomotion movement via an increase in the resistance to contraction of the first muscle 12 provided by the garment 30 during locomotion of the wearer. Increased muscular activity due to establishing resistance to muscle 12 contraction may beneficially result in increased calorie consumption and toning of the activated muscles 12, which may further lead to improved posture and balance.

In an embodiment of the present invention, the increase in the resistance to contraction of the first muscle 12 provided by the garment 30 may be due at least in part to the presence of the activation element 34. This may be the case in embodiments where the activation element 34 has a resistance to stretching greater than the base level resistance to stretching of the base layer 32.

When a portion of the garment 30 including the activation element 34 is stretched during a locomotion movement that is caused in part by a contraction of the first muscle 12, the muscle 12 may experience increased resistance to contraction as compared to situations where the garment 30 was absent, where the garment 30 did not contain the activation element 34, or where the activation element's 34 resistance to stretching was lower. In response to this increased resistance, the first muscle 12 must work harder and increase its muscle 12 activity to execute the locomotion movement.

For example, in one embodiment, a garment 30 in the form of a pair of pants, such as those illustrated in FIGS. 1A, 1B, and 2, may include an activation element 34 that is present on both the inner 38 and outer 36 surfaces of the garment 30. The activation element 34 may be located such that the inner surface 38 of the activation element 34 may contact (either directly or indirectly) the back of the wearer's thigh.

After donning the garment 30, when the wearer engages in certain locomotion movements—such as the movement depicted in FIG. 3F, where the foot 10 is accelerating forward in swing phase, the knee is being extended, and the thigh is being lifted forward—there will be a tendency for the portion of the garment 30 including the activation element 34 to be elongated or stretched. As described above, one muscle 12 involved in driving such a motion is the rectos femoris 20. However, because the activation element 34 may have a significant resistance to stretching, the rectus femoris 20 may experience increased resistance to contraction. Accordingly, the activation element 34 may cause the rectus femoris 20 to work harder and increase its muscle 12 activity to execute the locomotion movement.

The foregoing description is exemplary only. In other embodiments, the garment 30 may be configured and arranged such that the activation element 34 of the garment 30 may be in contact with a different portion of the wearer's limb and may cause increased muscle 12 activity in a different muscle.

As a further example, the activation element 34 may be located such that the inner surface 38 of the activation element 34 may contact (either directly or indirectly) the front of the wearer's thigh. After donning the garment 30, when the wearer engages in certain locomotion movements—such as the movement depicted in FIG. 3E, where the foot 10 is moving backward as the toe and leg are being lifted backward off the ground surface—there will be a tendency for the portion of the garment 30 including the activation element 34 to be elongated or stretched. As described above, muscles 12 involved in driving such a motion are the biceps femoris 22 and the gluteus maximus 24. However, because the activation element 34 may have a significant resistance to stretching, the biceps femoris 22 and the gluteus maximus 24 may experience increased resistance to contraction. Accordingly, the activation element 34 may cause the biceps femoris 22 and the gluteus maximus 24 to work harder and increase their muscle 12 activity to execute the locomotion movement.

In another embodiment of the present invention, the garment 30 is configured to be able to cause increased activity in a muscle 12 in the wearer's limb during a locomotion movement via an increase in compression about the limb provided by the garment 30 during locomotion of the wearer.

In an embodiment of the present invention, the increase in compression about the limb provided by the garment 30 may be due at least in part to the presence of the activation element 34. This may be the case in embodiments where the activation element 34 has a resistance to stretching greater than the base level resistance to stretching of the base layer 32.

When a portion of the garment 30 including the activation element 34 is stretched during a locomotion movement, a muscle 12 proximate to the activation element 34 may experience increased external compression as compared to situations where the garment 30 was absent, where the garment 30 did not contain the activation element 34, or where the activation element's 34 resistance to stretching was lower. In response to this increased compression, the muscle 12 may be stimulated and its muscle 12 activity may be increased.

One way that the muscle 12 may be stimulated to increase its muscle 12 activity is via a proprioceptive response. Just underneath the surface of the skin, muscles 12, ligaments, and tendons of the body are receptors known as proprioceptive receptors. As will be apparent to those of ordinary skill in the art, proprioceptive receptors are capable of initiating activity in their associated muscles 12 after sensing relative motion between, or other tactile sensations on, portions of the skin in the vicinity of these receptors. Compression may enhance the proprioceptive response by increasing the friction between the garment 30 and the portion of the wearer's limb proximate to the underlying muscle 12 and containing proprioceptive receptors associated with the muscle. Relative motion between the garment 30 and the portion of the wearer's limb proximate to the underlying muscle 12 is more likely to be transmitted directly to the surface of the skin and sensed by the proprioceptive receptors under compressed conditions.

For example, in one embodiment, a garment 30 in the form of a pair of pants, such as those illustrated in FIGS. 1A, 1B, and 2, may include an activation element 34 that is present on both the inner 38 and outer 36 surfaces of the garment 30. The activation element 34 may be located such that the inner surface 38 of the activation element 34 may contact (either directly or indirectly) the back of the wearer's thigh.

After donning the garment 30, when the wearer engages in certain locomotion movements—such as the movement depicted in FIG. 3F, where the foot 10 is accelerating forward in swing phase, the knee is being extended, and the thigh is being lifted forward—there will be a tendency for the portion of the garment 30 including the activation element 34 to be elongated or stretched. As described above, the activation element 34 in this arrangement may be proximate to the portion of the skin of the limb overlying the biceps femoris 22 and/or the gluteus maximus 24. Because the activation element 34 may have a significant resistance to stretching, the garment 30 may contract about the limb, and the biceps femoris 22 and/or the gluteus maximus 24 proximate to the activation element 34 may experience increased external compression. This may lead to a proprioceptive response, as described above. Accordingly, the activation element 34 may cause stimulation of the biceps femoris 22 and/or the gluteus maximus 24 and their muscle 12 activities may be increased.

The foregoing description is exemplary only. In other embodiments, the garment 30 may be configured and arranged such that the activation element 34 of the garment 30 may be in contact with a different portion of the wearer's limb and may cause increased muscle 12 activity in a different muscle.

As a further example, the activation element 34 may be located such that the inner surface 38 of the activation element 34 may contact (either directly or indirectly) the front of the wearer's thigh. After donning the garment 30, when the wearer engages in certain locomotion movements—such as the movement depicted in FIG. 3E, where the foot 10 is moving backward as the toe and leg are being lifted backward off the ground surface—there will be a tendency for the portion of the garment 30 including the activation element 34 to be elongated or stretched. As described above, the activation element 34 in this arrangement may be proximate to the portion of the skin of the limb overlying the rectus femoris 20. Because the activation element 34 may have a significant resistance to stretching, the garment 30 may contract about the limb, and the rectus femoris 20 proximate to the activation element 34 may experience increased external compression. This may lead to a proprioceptive response, as described above. Accordingly, the activation element 34 may cause stimulation of the rectus femoris 20 and its muscle 12 activity may be increased.

Accordingly, garments 30 of the present invention according to various embodiments may be configured to be able to cause increased muscle 12 activity in a wearer's limb during a locomotion movement in a variety of different ways. Increased muscular activity may beneficially result in increased calorie consumption and toning of the activated muscles 12, which may further lead to improved posture and balance. Thus, users of the garments 30 are provided with a better way to achieve their physical fitness goals while engaging in physical activity while minimizing the time and equipment investments required. Because of the nature of the garments 30, a user may choose to don the garment 30 throughout the ordinary course of their daily routine (e.g. while doing work, running errands, gardening, etc.). Thus the individual is not required to allocate a block of time out of the individual's regular daily routine for a workout.

A single garment 30 according to embodiments of the present invention may utilize the increased resistance against muscle 12 contraction, a compression-based proprioception response, or both to achieve a desired increase in muscle 12 activity. The same garment 30 may be capable of affecting one muscle 12 on one side of a limb with one method and affecting another muscle 12 on the other side of the limb with another method.

The degree of increased muscle 12 activity may be affected by a variety of variables. Factors related to the level of resistance to stretching of the base layer 32 and the activation element 34 may affect the degree of increased muscle 12 activity. For example, relevant factors may include the base level of resistance to stretching of the base layer 32 of the garment 30, the resistance to stretching of the activation element 34 of the garment 30, the amount of difference between the base level of resistance to stretching of the base layer 32 and the resistance to stretching of the activation element 34. In an embodiment, the greater the difference between the base level of resistance to stretching of the base layer 32 and the resistance to stretching of the activation element 34, the greater the localization of the increased muscle 12 activation will be, based on the location of the activation element 34.

Additional factors may include the size, shape, location, and orientation of the activation element 34, and the material compositions of the base layer 32 and the activation element 34.

In some embodiments of the present invention, the location of the activation element 34 on the garment 30 may be limited between certain bounds. For example, in an embodiment, the activation element 34 is configured not to extend above the upper most extent of the gluteus maximus 24 when the garment 30 is donned. In another embodiment, the activation element 34 is configured not to extend above the lower most extent of the gluteus maximus 24. In yet another embodiment, the activation element 34 is configured not to extend below the top of the wearer's knee area. In an embodiment, the more narrow the bounds of the activation element 34 are, the greater the localization of the increased muscle 12 activation will be.

While the foregoing exemplary embodiments have primarily illustrated the use garments 30 in the form of pants, the same principles apply to other types of garments 30. Furthermore, while the examples have focused on the effect of a garment 30 on one of a person's limbs, the same principles would apply to both of a person's limbs where a garment 30, such as a pair of pants, has an activation element 34 on each leg.

Moreover, the size, shape, orientation, and quantity of the activation elements 34 are not limited to those discussed in the foregoing examples.

Figure 6A:
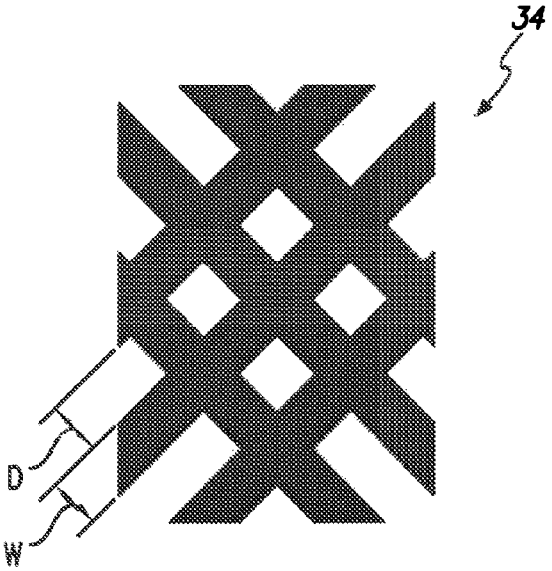
FIG. 6A is an isolated view of the activation element of FIG. 1A according to an embodiment of the present invention.
Figure 6B:
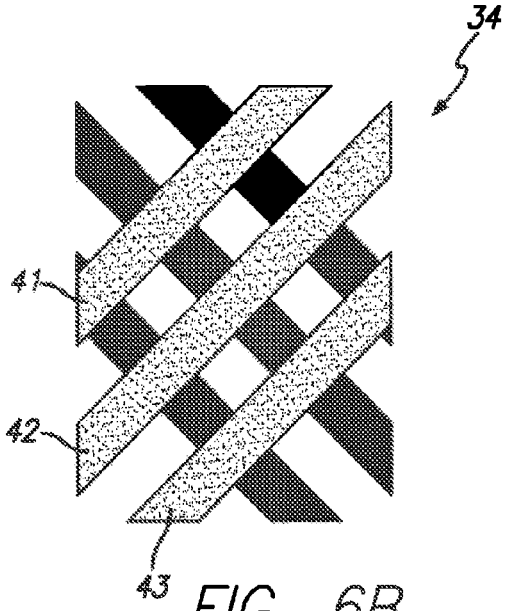
FIG. 6B is an illustration of the activation element of FIG. 6A with several activation components highlighted according to an embodiment of the present invention.
Figure 6C:
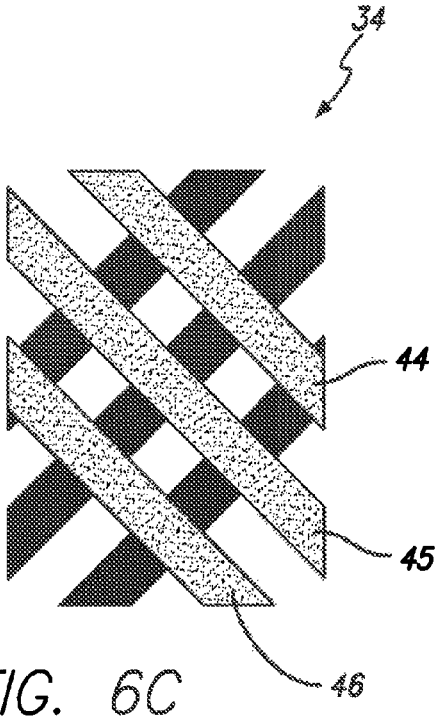
FIG. 6C is an illustration of the activation element of FIG. 6A with several activation components highlighted according to an embodiment of the present invention.

The activation element 34 depicted as being coupled the base layer 32 in FIGS. 1A, 1B, and 2 is illustrated in isolation in FIGS. 6A, 6B, and 6C. While FIGS. 1A, 1B, and 2 illustrate a single garment 30 having two activation elements 34 (i.e. one on each pant leg), embodiments of the present invention may include any number of activation elements 34. Greater numbers of activation elements 34 may allow for the targeting of greater numbers of muscles 12 for activation, which may beneficially result in increased calorie consumption and toning of the activated muscles 12, which may further lead to improved posture and balance.

Returning to FIG. 6A, the illustrated activation element 34 is non-continuous. In other words, portions of the activation element 34 include voids or gaps that may be filled by the base layer 32. In one embodiment, the voids or gaps may be filled with another material, or may not be filled. Non-filled voids or gaps may provide the benefit of increasing the breathability or moisture wicking capabilities of the garment 30. In other embodiments, activation elements 34 may be continuous in that they do not include voids or gaps.

The activation element 34 of FIGS. 6A, 6B, and 6C may comprise a plurality of smaller activation components. As illustrated in FIGS. 6A, 6B, and 6C, the activation element 34 may include a first activation component 41, second activation component 42, third activation component 43, fourth activation component 44, fifth activation component 45, and sixth activation component 46. In alternate embodiments, the activation element 34 may include fewer or greater than six smaller activation component.

As described above, the activation element 34 may either be integrally formed with the base layer 32, or the activation element 34 may be coupled to the base layer 32 after the base layer 32 and the activation element 34 were previously separately formed. Similarly, the first through sixth activation components 41-46 may either be integrally formed with the base layer 32, or the first through sixth activation components 41-46 may be coupled to the base layer 32 after the base layer 32 and the first through sixth activation components 41-46 were previously separately formed.

Moreover, the first through sixth activation components 41-46 may either be integrally formed with one another, or the individual first through sixth activation components 41-46 may be coupled to one another after each of the first through sixth activation components 41-46 were previously separately formed.

In embodiments where the first through sixth activation components 41-46 are integrally formed with one another, the distinction between the larger activation element 34 and the smaller first through sixth activation components 41-46 becomes less relevant—the whole structure is integrally formed as a single piece. In this case, smaller activation components that would appear in the figures to overlap one another, such as, for example, first and fourth activation components 41 and 44 depicted in FIGS. 6B and 6C, should be understood to be merely different regions of an integrally formed larger activation element 34.

In embodiments where the first through sixth activation components 41-46 are coupled to one another after each of the individual first through sixth activation components 41-46 has separately been formed, activation components that would appear to overlap one another, such as, for example, first and fourth activation components 41 and 44 depicted in FIGS. 6B and 6C, should be understood to be physically overlapping one another, and to collectively form a larger activation element 34. This could be achieved, for example, by applying the various activation components 41-46 as separate pieces of silicon, thermoplastic or thermosetting polymers, rubber, polyurethane, or a laminate.

In an embodiment of the present invention, the various activation components 41-46 may each have resistances to stretching that are different from one another. Alternatively, the various activation components 41-46 may each have equal resistances to stretching. The various activation components 41-46 may further have resistances to stretching that are greater than the base level resistance to stretching exhibited by the base layer 32. Using different resistances to stretching in different locations may allow for a garment 30 that is particularly suitable for particular muscles 12 or muscle 12 groups, particular motions, or particular physical activities.

In one embodiment, as illustrated in FIGS. 6A, 6B, and 6C, at least a portion of each of the first through sixth activation components 41-46 is linear. In some embodiments, one or more of the first through sixth activation components 41-46 are entirely linear.

As further depicted in FIG. 6B, the linear portions of the first, second, and third activation components 41, 42, and 43 may be parallel to one another. Furthermore, as depicted in FIG. 6C, the linear portions of the fourth, fifth, and sixth activation components 44, 45, and 46 may be parallel to one another. In an additional embodiment, as depicted in FIGS. 6A, 6B, and 6C, the linear portions of the first, second, and third activation components 41, 42, and 43 may be perpendicular to the linear portions of the fourth, fifth, and sixth activation components 44, 45, and 46. In one embodiment, the activation layer 34 may comprise a cross-hatched or lattice pattern. In this manner, activation layer 34 may include or resemble crossed strips of material including open spaces or voids between the strips. Embodiments of the activation layer 34 need not necessarily actually be formed by crossed strips of material—the material may be a unitary, integrally formed structure. Various other patterns, including parallel or perpendicular arrangements, may be beneficial in encouraging muscle 12 activation based on particular motions, or particular physical activities.

In one embodiment, the linear portions of the first, second, and third activation components 41, 42, and 43 may intersect the linear portions of the fourth, fifth, and sixth activation components 44, 45, and 46 at an offset of approximately 40 degrees to 60 degrees. In another embodiment, the offset may be approximately 45 degrees to 55 degrees. In a further embodiment, the offset may be approximately 50 degrees.

Other configurations are possible and within the scope of the present invention. For example, one or more of the activation components 41-46 may be non-linear. As a further example, one or more of the activation components 41-46 may not be parallel to an adjacent activation component 41-46. In addition, the activation element 34 may be made up of more or less than six activation components.

With reference to FIG. 6A, in one embodiment where an activation component, such as activation component 41, has a length that is greater than its width, the activation component 41 may have a width of W. In an embodiment, width W may be greater than ⅛ inch and less than 2 inches. In another embodiment, width W may be greater than ½ inch and less than 1½ inches. In some embodiments the widths of each of activation component 41-46 may be equal to W. In other embodiments, adjacent activation components, such as activation components 41 and 42, may be spaced apart from one another by a distance D. In one embodiment, each of activation component 41-46 may be spaced apart from adjacent activation components 41-46 by a distance D. In an embodiment, distance D may be about equal to width W.

Figure 11:
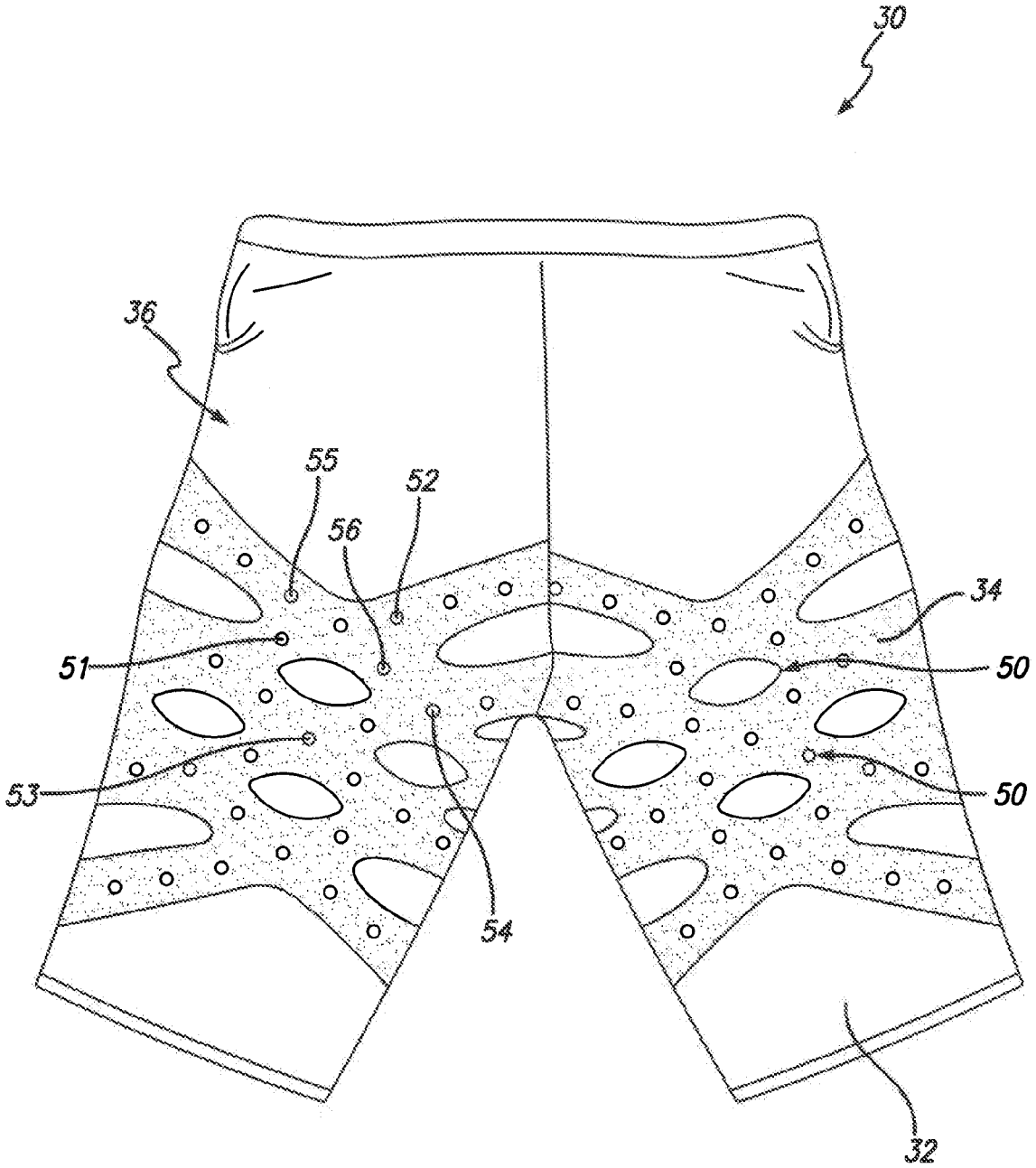
FIG. 11 is a rear view of an outside surface of a garment according to an embodiment of the present invention.

FIG. 11 illustrates a rear view of the outer surface 36 of a garment 30 in the form of a pair of shorts that differs in some respects from the garment 30 illustrated in FIG. 8. In the embodiment of FIG. 11, the illustrated activation element 34 is non-continuous. In other words, portions of the activation element 34 include voids 50 that may be filled by the base layer 32. As described above, the activation element 34 may be coupled to the base layer 32 after the base layer 32 and the activation element 34 were previously separately formed.

In one embodiment, as shown in FIG. 11, the activation element 34 may include a plurality of voids 50 formed therein such that the activation element 34 comprises a lattice pattern. The lattice pattern may surround the plurality of voids 50. In one embodiment, as shown in FIG. 11, the plurality of voids 50 may comprise circular or marquise shaped voids. Because areas where the activation element 34 is disposed on the base layer 32 may have more material, the voids 50 may provide for areas of increased breathability of the garment 30.

In one embodiment, during manufacturing the activation element 34 may first be provided without the voids 50, and the voids 50 may subsequently be cut into the activation element 34. For example, the voids 50 may be cut with a die or laser.

Various characteristics including, but not limited to, the geometry of the pattern of the activation element 34, the size and shape of the voids 50, the degree of void symmetry, and the shape of the activation element 34 surrounding the voids 50, may be selected to provide the desired stretch resistance to the garment 30. Further, in some embodiments, these characteristics may be selected to provide the desired stretch resistance to the garment 30 in particular directions of movement. For example, when stretched in different directions, a latticed portion of the activation element 34 having a circle shaped void 50 might have similar stretch and modulus in all directions, depending also upon the shape of the activation element 34 that surrounds the void. In other embodiments, shapes such as marquises, triangles, squares, and hexagons might have different stretch and modulus in various directions.

In some embodiments, the activation element 34 can be aligned to give a desired stretch and modulus in a given movement direction (e.g., along a muscle or in a direction to oppose muscle movement). In other embodiments, the activation element 34 is constructed to give a variety of stretch resistances in a variety of garment 30 movement directions. The variety of stretch characteristics may be planned such that the user is aware of the affected movement directions. In some embodiments, the variety of stretch and modulus characteristics may be random.

The voids 50 of FIG. 11 may comprise a plurality of different voids. As illustrated in FIG. 11, the activation element 34 may include a first void 51, second void 52, third void 53, fourth void 54, fifth void 55, and sixth void 56. In alternate embodiments, the activation element 34 may include fewer or greater than six voids 50.

In an embodiment, as illustrated in FIG. 11, first void 51, second void 52, third void 53, and fourth void 54 may be configured such that a line drawn connecting the center point of the first void 51 and the center point of the second void 52 would be parallel to a line drawn connecting the center point of the third void 53 and the center point of the fourth void 54. In a further embodiment, also as illustrated in FIG. 11, fifth void 55 and sixth void 56 may be configured such that a line drawn connecting the center point of the fifth void 55 and the center point of the sixth void 56 would not be parallel to lines connecting the center points of the first void 51 and the second void 52 or the center points of the third void 53 and the fourth void 54. In an alternative embodiment, the fifth void 55 and sixth void 56 may be configured such that a line drawn connecting the center point of the fifth void 55 and the center point of the sixth void 56 would be perpendicular to lines connecting the center point of the first void 51 and/or the center point of the second void 52 or the center point of the third void 53 and the center point of the fourth void 54.

In one embodiment, a line drawn connecting the center point of the first void 51 and the center point of the second void 52 may intersect a line drawn connecting the center point of the fifth void 55 and the center point of the sixth void 56 at an offset of approximately 40 degrees to 60 degrees. In another embodiment, the offset may be approximately 45 degrees to 55 degrees. In a further embodiment, the offset may be approximately 50 degrees. In still further embodiments, as described above with respect to FIG. 8, the activation element 34 may comprise a lattice pattern wherein linear portions of the activation element are also offset by approximately 40 degrees to 60 degrees, 45 degrees to 55 degrees, or 50 degrees.

Figure 7:
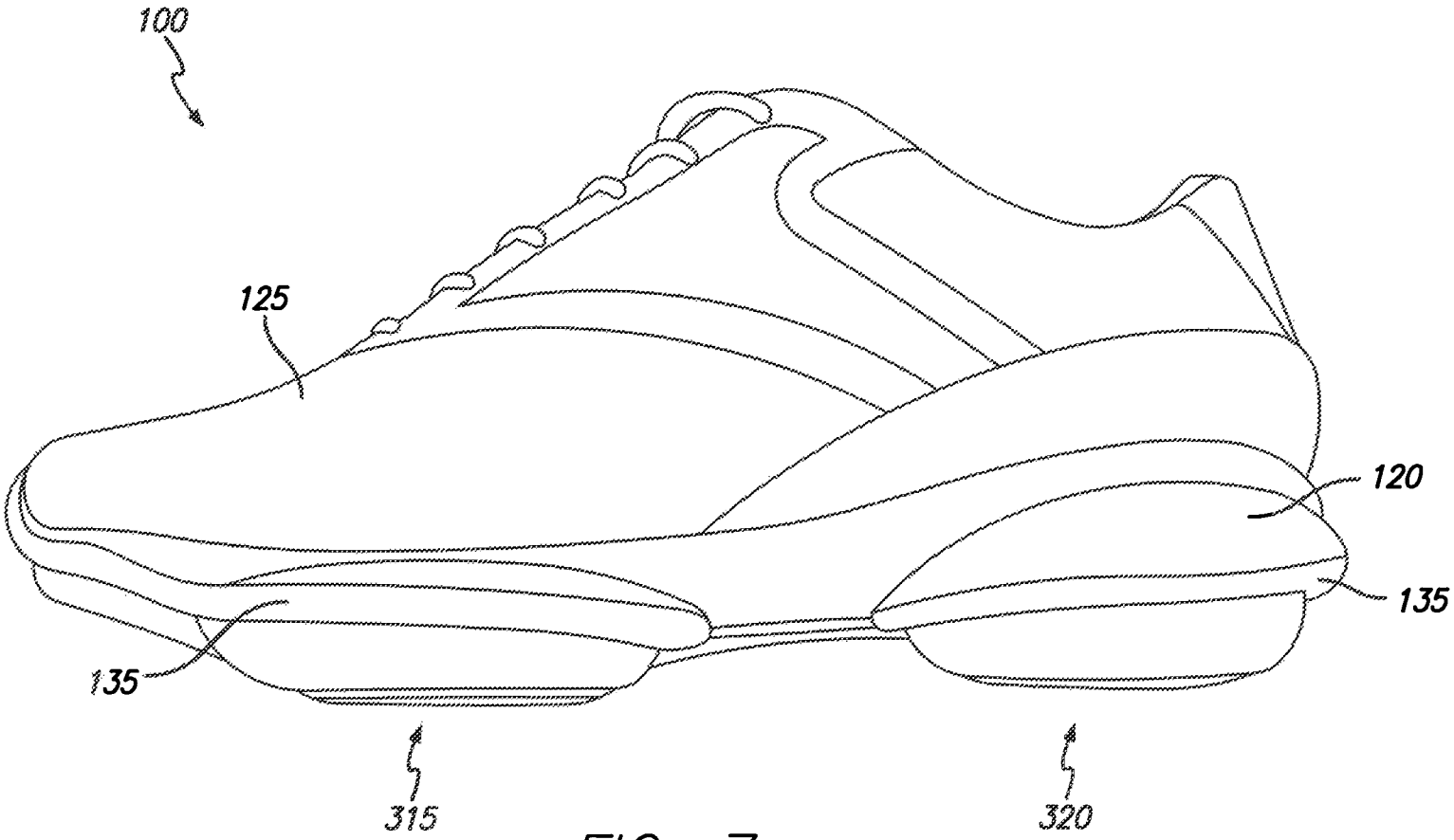
FIG. 7 is an illustration of a shoe according to an embodiment of the present invention.

In one embodiment of the present invention, the garment 30 of the present invention may be used in conjunction with a shoe 100 similar to those disclosed in pending U.S. patent application Ser. No. 12/416,698 to McInnis et al. and U.S. patent application Ser. No. 12/571,327 to Litchfield et al., the disclosures of which are incorporated herein in their entireties by reference thereto. As illustrated in FIG. 7, the shoe 100 may include an upper 125, a midsole 120, and an outsole 135. The shoe 100 may include a forefoot bulge 315 and a heel bulge 320. The bulges 315 and 320 may protrude downward from the shoe 100 towards the ground surface such that when the wearer of the shoe 100 walks on the ground surface, the wearer's muscles 12 may be forced to exert themselves to stabilize the wearer's gait. Thus, muscular activity in the wearer is increased. Thus the use of the shoe 100 and the garment 30 of the present invention together may provide even greater increased muscular activity that may beneficially result in increased calorie consumption and toning of the activated muscles 12, which may further lead to improved posture and balance.

Thus, the garments 30 of embodiment of the present invention may allow a wearer to better achieve his or her physical fitness goals while engaging in physical activity throughout the course of his or her daily routine, while minimizing the heavy equipment and time investments required.

The present invention has been described above by way of exemplary embodiments. Accordingly, the present invention should not be limited by any of the above-described exemplary embodiments, but should be defined only in accordance with the following claims and their equivalences.

What is claimed is:

1. A garment for being placed in contact with a wearer's limb, comprising:

a base layer having a base level resistance to stretching; and an activation element layer disposed on a surface of said base layer, said activation element layer not being integrally formed with said base layer, and said activation element layer comprising a lattice pattern and having a resistance to stretching greater than the base level resistance to stretching, wherein the activation element layer further comprises:

a first activation component said first activation component having a first resistance to stretching that is greater than the base level resistance to stretching;

a second activation component, said second activation component having a second resistance to stretching that is greater than the base level resistance to stretching;

a third activation component, said third activation component having a third resistance to stretching that is greater than the base level resistance to stretching;

wherein a portion of said first activation component, a portion of said second activation component, and a portion of said third activation component are all linear, wherein the linear portions of said first, second, and third activation components are parallel to one another, wherein said activation element layer is configured to be placed in contact with the back of the wearer's thigh, not to extend above the upper most extent of the gluteus maximus, and not to extend below the knee, and wherein the garment is configured to be able to cause increased activity in a first muscle in the wearer's limb during a locomotion movement via an increase in the resistance to contraction of the first muscle provided by the garment during locomotion of the wearer.

2. The garment of claim 1, wherein the garment is a pair of pants.

3. The garment of claim 1, wherein the garment is a pair of shorts.

4. The garment of claim 1, wherein the garment is an undergarment.

5. The garment of claim 1, wherein said base layer is comprised of a textile.

6. The garment of claim 1, wherein said activation element layer is coupled to said base layer by fabricating one portion of the garment including said activation element layer differently from another portion of the garment that does not include said activation element layer.

7. The garment of claim 1, wherein said activation element layer comprises different thicknesses or textures in different portions of the garment.

8. The garment of claim 1, wherein said activation element layer is coupled to said base layer by an adhesive.

9. The garment of claim 1, wherein said activation element layer is coupled to said base layer by sewing or stitching.

10. The garment of claim 1, wherein said activation element layer is coupled to said base layer by an application of heat or pressure.

11. The garment of claim 1, wherein said base layer comprises spandex.

12. The garment of claim 1, wherein, said base layer comprises nylon.

13. The garment of claim 1, wherein, said base layer comprises a mesh material.

14. The garment of claim 1, wherein the linear portions of said first, second, and third activation components each have a width W in a first direction.

15. The garment of claim 14, wherein the portions of said first, second, and third activation components are equally spaced apart from one another by a distance D in the first direction.

16. The garment of claim 15, wherein the width W is equal to the distance D.

17. The garment of claim 14, wherein W is greater than ⅛ inch and less than 2 inches.

18. The garment of claim 1, wherein the first, second, and third resistances to stretching are equal.

19. The garment of claim 1, wherein each of said first, second, and third activation components are coupled to said base layer.

20. The garment of claim 1, wherein the activation element layer further comprises:

a fourth activation component, said fourth activation component having a fourth resistance to stretching that is greater than the base level resistance to stretching;

a fifth activation component, said fifth activation component having a fifth resistance to stretching that is greater than the base level resistance to stretching;

a sixth activation component, said sixth activation component having a sixth resistance to stretching that is greater than the base level resistance to stretching;

wherein a portion of said fourth activation component, a portion of said fifth activation component, and portion of said sixth activation component are all linear, wherein the linear portions of said fourth, fifth, and sixth activation components are parallel to one another, and wherein the linear portions of said fourth, fifth, and sixth activation components are perpendicular to the linear portions of said first, second, and third activation components.

21. The garment of claim 20, wherein the first, second, third, fourth, fifth, and sixth resistances to stretching are equal.

22. The garment of claim 20, wherein said first, second, third, fourth, fifth, and sixth activation components are integrally formed with one another.

23. The garment of claim 20, wherein each of said first, second, third, fourth, fifth, and sixth activation components are coupled to said base layer.

24. The garment of claim 1, wherein said activation element layer is configured not to extend above the lower most extent of the gluteus maximus, and not to extend below the top of the knee, when the garment is placed in contact with the back of the wearer's thigh.

25. The garment of claim 1, wherein the first muscle is one of the muscles in the hamstring group of muscles.

26. The garment of claim 25, wherein the first muscle is the biceps femoris.

27. The garment of claim 1, wherein the first muscle is the gluteus maximus.

28. The garment of claim 1, wherein the locomotion movement involves knee extension.

29. The garment of claim 1, wherein the locomotion movement involves knee flexion.

30. The garment of claim 1, wherein the garment is configured for being placed directly in contact with the wearer's limb.

31. The garment of claim 1, wherein the garment is configured for being placed indirectly in contact with the wearer's limb.

32. The garment of claim 1, wherein a plurality of voids are disposed within the activation element layer.

33. The garment of claim 32, wherein at least one of the plurality of voids is marquise shaped.

34. The garment of claim 32, wherein a first line formed by a center point of a first void and a center point of a second void and a second line formed by a center point of a third void and a center point of a fourth void are parallel to one another.

35. The garment of claim 1, wherein said activation element layer is disposed on said base layer by spraying or printing.

36. A garment for being placed in contact with a wearer's limb, comprising:

a base layer having a base level resistance to stretching; and an activation element disposed on said base layer, said activation element not being integrally formed with said base layer, and said activation element having a first resistance to stretching that is more resistant to stretching than the base level resistance to stretching, wherein the activation element further comprises:

a first activation component, said first activation component having a first resistance to stretching that is greater than the base level resistance to stretching;

a second activation component, said second activation component having a second resistance to stretching that is greater than the base level resistance to stretching;

wherein a portion of first activation component and a portion of said second activation component are linear, wherein the linear portions of said first and second activation components are parallel to one another, wherein said activation element is configured to be placed in contact with the hack of the wearer's thigh, not to extend around the front of the wearer's thigh, not to extend above the upper most extent of the gluteus maximus, and not to extend below the knee, and wherein the garment is configured to be able to cause increased activity in a muscle in the wearer's limb during a locomotion movement via an increase in compression about the limb provided by the garment during locomotion of the wearer.

37. The garment of claim 36, wherein the increase in compression is sufficient to activate a proprioceptive receptor associated with the muscle during the locomotion movement.

38. The garment of claim 36, wherein the garment is configured to be placed in contact with a portion of skin of the wearer's limb that is proximate to the muscle, and wherein the increase in compression is sufficient to increase friction between the garment and the portion of the skin proximate to the muscle during the locomotion movement.

39. The garment of claim 38, wherein relative motion is still capable of occurring between the garment and the portion of the skin proximate to the muscle during the locomotion movement.

40. A garment for being placed in contact with a portion of the skin of a wearer's limb, comprising:

a base layer having a base level resistance to stretching; and an activation element layer disposed on a surface of said base layer, said activation element layer not being integrally formed with said base layer, and said activation element layer having a resistance to stretching greater than the base level resistance to stretching, wherein the activation element layer further comprises:

a first activation component, said first activation component having a first resistance to stretching that is greater than the base level resistance to stretching;

a second activation component, said second activation component having a second resistance to stretching that is greater than the base level resistance to stretching;

wherein a portion of said first activation component and a portion of said second activation component are linear, wherein the linear portions of said first and second activation components are parallel to one another, wherein said activation element layer is configured to be placed in contact with the back of the wearer's thigh, not to extend above the upper most extent of the gluteus maximus, and not to extend below the knee, wherein the garment is configured to be able to cause increased activity in a first muscle in the wearer's limb during a locomotion movement via an increase in the resistance to contraction of the first muscle provided by the garment during locomotion of the wearer, and wherein the garment is configured to be able to cause increased activity in a second muscle in the wearer's limb during a locomotion movement via an increase in compression about the limb provided by the garment during locomotion of the wearer.

41. The garment of claim 40, wherein the first muscle is on one side of the limb and the second muscle is on an opposite side of the limb.

42. The garment of claim 40, wherein the first muscle is an antagonist of the second muscle.

43. The garment of claim 40, wherein the first muscle is the rectus femoris and the second muscle is the biceps femoris.

* * * * *

UNITED STATES PATENT AND TRADEMARK OFFICE

CERTIFICATE OF CORRECTION

PATENT NO. : 9,095,177 B2
APPLICATION NO. : 13/070964
DATED : August 4, 2015
INVENTOR(S) : Ota et al.

It is certified that error appears in the above-identified patent and that said Letters Patent is hereby corrected as shown below:

Claims

Column 16, line 17, Claim 1: "a first activation component said first activation component" should read --a first activation component, said first activation component--.

Column 18, line 31, Claim 36: "wherein a portion of first activation component" should read --wherein a portion of said first activation component--.

Signed and Sealed this
Twenty-ninth Day of March, 2016

Michelle K. Lee

Michelle K. Lee
*Director of the United States Patent and Trademark Office*